United States Patent [19]

Parrini et al.

[11] 4,162,996

[45] Jul. 31, 1979

[54] FIBROUS MATERIALS USEFUL AS LEATHER SUBSTITUTES AND CONSISTING ESSENTIALLY OF LEATHER FIBERS, FIBRILS OR FIBRIDES OF SYNTHETIC POLYMERS AND CELLULOSE FIBERS

[75] Inventors: Paolo Parrini, Ferrara; Giuseppe Peroni, Gussago (Brescia); Guglielmo Corrieri; Gian P. Righi, both of Ferrara, all of Italy

[73] Assignee: Montedison S.p.A., Milan, Italy

[21] Appl. No.: 772,096

[22] Filed: Feb. 25, 1977

[30] Foreign Application Priority Data

Feb. 26, 1976 [IT] Italy ..... 20617 A/76

[51] Int. Cl.[2] ..... D21H 15/20; C08L 89/00; C08L 89/06; C08L 7/02

[52] U.S. Cl. ..... 260/4 R; 162/144; 260/6; 260/8

[58] Field of Search ..... 260/4 R, 8, 6; 162/144

[56] References Cited

U.S. PATENT DOCUMENTS

| | | | |
|---|---|---|---|
| 3,026,242 | 3/1962 | Emery et al. | 162/144 |
| 3,116,200 | 12/1963 | Young et al. | 260/8 |
| 3,436,303 | 4/1969 | Raymond et al. | 162/144 |
| 3,616,169 | 10/1971 | Okamura | 162/144 |
| 3,619,275 | 11/1971 | Barash et al. | 162/144 |
| 3,708,333 | 1/1973 | Carlson | 162/144 |
| 3,947,316 | 3/1976 | Kremr et al. | 162/144 |

*Primary Examiner*—John C. Bleutge

[57] ABSTRACT

There are disclosed fibrous materials useful as leather substitutes and consisting essentially of the combination of leather fibers, cellulose fibers and fibrils or fibrides of synthetic polymers having a surface area larger than 1 $m^2/g$.

5 Claims, No Drawings

FIBROUS MATERIALS USEFUL AS LEATHER SUBSTITUTES AND CONSISTING ESSENTIALLY OF LEATHER FIBERS, FIBRILS OR FIBRIDES OF SYNTHETIC POLYMERS AND CELLULOSE FIBERS

THE PRIOR ART

As is known, attempts have been made to prepare commercially acceptable leather substitutes by combining leather fibers or wastes with natural and/or synthetic fibers and binders.

French Pat. No. 1,551,247 is concerned with leather-like products of the kind referred to hereinabove. According to that patent, leather-like products are obtained by treating a mixture of leather fibers and a latex of particular synthetic fibers with a flocculating agent and subsequent transformation into sheets by filtration, compression and drying.

According to U.S. Pat. No. 3,505,169, a type of regenerated leather is prepared by mixing, in water, leather fibers and the latex of a particular urethane polymer, optionally also with cellulose fibers, followed by transformation of the suspension to a sheet and vulcanization of the solid polymer contained therein.

Further, according to U.S. Pat. No. 3,436,303, sheets of leather-like materials are prepared starting from aqueous dispersions containing 50 to 80% by weight of globular particles of an elastomeric polyurethane, and 20 to 50% by weight of fibrous material, of which at least one third consists of leather fibers and the remaining portion of conventional synthetic staple fibers, optionally mixed with cellulose fibers, through the steps of forming a sheet from such dispersions, of drying and, finally, of heating the sheet to a high temperature.

All these methods are considerably limited by the necessity of employing expensive materials and complex modalities. Furthermore, the resulting products, although similar to leather in tenacity and other mechanical properties, remain remarkably inferior to leather as regards other important characteristics, such as porosity, moisture absorption and dimensional stability to water, and therefore cannot be used satisfactorily for various purposes.

An object of the present invention is to prepare a leather-like material, characterized by high porosity, dimensional stability to water and abrasion resistance, and at the same time possessed of mechanical properties comparable to those of the best regenerated leathers available on the market.

This and other objects are achieved by the invention which provides leather-like materials which comprise (I) a fibers mixture composed of:

30–60% by weight of leather fibers;

35–65% by weight of fibrils, or fibrides, of synthetic polymers, having a surface area larger than 1 $m^2/g$;

5–15% by weight of cellulose fibers; and (II) a binder for the fibrous material constituting the above-said mixture, in an amount ranging from 3 to 50 parts by weight for 100 parts by weight of such fibers mixture.

The objects of this invention include a process for preparing the aforesaid materials, that consists in preparing an aqueous dispersion comprising:

(I) a fibers mixture composed of:

30–60% by weight of leather fibers;

35–65% by weight of fibrils, or fibrides, of synthetic polymers, having a surface area larger than 1 $m^2/g$;

5–15% by weight of cellulose fibers; and (II) a binder for the fibrous material constituting the above-said mixture, in an amount ranging from 3 to 50 parts by weight for 100 parts by weight of the fibers mixture, in forming a sheet, or a panel, by depositing such dispersion onto a filtering septum, and in developing the adhesion properties of the binder at a temperature lower than the melting temperature of the polymer forming the aforesaid fibrils or fibrides.

The term "fibrils" or "fibrides" of synthetic polymers generally means lengthened, non-granular structures, having diameters comprised between 1 and 400 microns and lengths comprised between 1 and 50 mm.

Such fibrils or fibrides are known to be particularly suited for the preparation of synthetic paper by conventional paper-making methods.

Several processes have been described for the preparation of synthetic polymer fibrils, or fibrides, having a surface area of more than 1 $m^2/g$.

According to Br. Pat. No. 868,651, such structures can be prepared by adding a synthetic polymer solution to a nonsolvent of the polymer, by simultaneously subjecting the polymer, either precipitated or swollen, to shearing stresses. A similar process is described also in German patent application No. 2,208,553.

According to British Pat. No. 1,287,917, morphologically analogous structures, also useful as substitutes for cellulose fibers in the preparation of paper, are obtained by polymerizing alpha-olefins in the presence of coordination catalysts, under the action exerted by the shearing stresses in the reaction medium.

Other methods of preparing fibrils of polymeric material consist in extruding through an orifice a solution, emulsion, or dispersion of the polymer in at least a liquid medium, under such temperature and pressure conditions as to cause an almost immediate evaporation of the liquid in the extrusion medium ("flash-spinning"), whereupon the polymer precipitates in the form of several fibrils, connected with one another so as to form more or less continuous, tridimensional fibrous structures or aggregates (plexofilaments), having a surface area exceeding 1 $m^2/g$, and a microfibrous structure, i.e., consisting in their turn of bundles or layers of microfibers the diameter of which, or smaller dimension, is below 1.0 micron.

Processes of the last-mentioned type, useful, for example, in preparing the above-said fibrils starting from homogeneous solutions of the polymer in a solvent, or from emulsions including the polymer, solvents and non-solvents (such as, e.g., water), or from dispersions of molten polymer in solvents and/or non-solvents, are described in British Pat. Nos. 891,943 and 1,262,531; U.S. Pat. Nos. 3,402,231, 3,227,784, 3,227,794, 3,770,856, 3,740,383, 3,808,091 and 3,081,519; Belgian Pat. No. 789,808; French Pat. No. 2,176,858 and German Patent application No. 2,343,543.

The fibrous aggregates, or the plexofilaments, prepared according to the "flash-spinning" method, can be easily disgregated, by cutting and refining, until the elementary fibrous structures (fibrils) having a surface area exceeding 1 $m^2/g$ are obtained.

British Pat. No. 891,945 describes the preparation of such elementary structures through disgregation of plexofilaments prepared by "flash-spinning" of polymeric solutions.

According to more recent methods, described in Italian Patent No. 947,919 and in Italian patent application No. 29,594 A/74, assigned to Montedison S.p.A., as well as in British Patents Nos. 1,355,912 and 1,355,913, fibrils provided with analogous characteristics can be obtained directly by subjecting solutions or dispersions of synthetic polymers in solvents and/or non-solvents, extruded under "flash" conditions, to the action of a gaseous fluid directed angularly and at a high speed against the extruded polymeric composition.

To achieve the objects of the present invention it is possible to employ fibrils or fibrides of synthetic polymers in general, such as, for example, of polymers of olefins, amides, styrene, acrylonitrile, acrylates, vinyl chloride, oxymethylene, the copolymer of the above said copolymerizable monomers, and preferably the ethylene-propylene copolymers and the copolymers of ethylene with alkyl acrylates. Inorganic fillers, such as kaolin, silica, gypsum, talc, calcium carbonate and titanium dioxide, may be present in the formed fibrils, in amounts up to 70% by weight referred to the total weight of the fibrils.

The leather fibers utilized in the products and in the process of this invention are preferably obtained from the scraping, or shaving, of animal skins, which is carried out before or during the tanning process in order to render the skin thickness uniform. However, it is possible to use the fibers obtained by grinding the leather off-cuts or wastes according to the methods generally employed in the art for converting such materials to fibrous form. Leather fibers having a length comprised between 1 and 5 mm are preferred.

Cellulose fibers for the present purposes can be obtained from any type of cellulose, including regenerated cellulose.

Suitable binders for the fibrous materials are all those natural or synthetic products, either in solution, or in emulsion or in any other physical state, capable of promoting adhesion among the fibers at a temperature lower than the melting temperature of the polymer that constitutes the synthetic fibrils or fibrides.

Such examples of employable binders are the latexes of natural rubber, either alone or in admixture with latexes of polyvinyl acetate as such, or of copolymers of vinyl acetate with lesser amounts of alkyl acrylates; latexes of vinyl polymers, such as polyvinyl chloride, polyvinyl acetate, copolymers of vinyl chloride with vinylidene chloride, vinyl chloride/vinyl acetate copolymers, vinyl chloride/alkyl acrylate copolymers; latexes of butadiene/acrylonitrile copolymers, and latexes of urethane polymers; and mixtures of said latexes.

Inorganic fillers, pigments and similar materials in powder form may be present in the dispersed state in the leather-like materials of this invention, up to a maximum of 5% by weight referred to the total weight of the fibrous material.

The aqueous suspension of fibrous materials from which the leather-like material of the present invention is prepared exhibits, preferably but not necessarily, a consistence similar to that of the cellulose pastes utilized in the preparation of paper. The mixing degree and the fluidity of the suspension can be more or less increased through the fiber refining carried out in refiners of the type used in paper mills.

In practice, the leather-like materials of the present invention are prepared by mixing with water, in a hollander, the leather fibers along with the fibrils or fibrides, with the cellulose and, optionally, with no more than 5% by weight, referred to the total weight of the fibers of one or more fillers or pigments in the form of a fine powder, in order to obtain an acqueous suspension containing about 20% by weight of fibrous material. After an optional refining treatment of the fibers, the binder, preferably in the form of an aqueous latex, is added to the solution and, after a further homogenization, the suspension is transformed, by deposition, into a sheet or a panel, using for the purpose a continuous flat machine as used in making paper. Due to the high adsorptivity of the fibrous material, practically all of the binder present in the suspension remains fixed to the fibers. The wet sheet so obtained can be dried at such temperature as to obtain the development of the binder's adhesive properties, without causing the melting of the polymer constituting the fibrils or fibrides contained in the sheet.

Although not necessarily, the wet sheet, prior to drying, can be passed between two cylinders under a pressure hardly sufficient to render uniform the thickness and the surface. At this stage, however, it is possible to operate even under a higher pressure that can vary according to the composition of the fibrous mixture, the surface area of the fibrils used and the type of binder present, if it is desired to remove the excess liquid and obtain a final product exhibiting a higher apparent density.

Generally, it has been found that the products having an apparent density comprised between 0.6 and 1 g/cc can be used in a remarkably wide range of applications, although useful products having a higher apparent density can be prepared according to the process of this invention.

By "apparent density" we mean the value of density which has been determined by cutting a square portion of the material of uniform thickness, calculating its volume from its dimensions, then weighing such portion and finally expressing the density thereof in terms of weight per unit volume.

The products according to this invention can be used instead of natural leather in particular in the preparation of insoles, supports for footwear of various types and, in general, in the preparation of all those leather substitutes for which high transpirability and dimensional stability to water, along with flexibility and abrasion resistance, are required.

Such products may be varnished and lacquered on their surfaces with the varnishing materials usually employed in the leather and skin industry, and may be transformed into products having a "hand" like that of the animal skin by means of a successive hot treatment under pressure, at a temperature lower than the melting temperature of the synthetic fibrils or fibrids present therein.

The following examples are given to illustrate both the process and products of the invention in greater detail and are not intended to be limiting.

Characteristics given for the products of the examples were determined as follows:

weight—Standards TAPPI 410 ES-68
thickness—Standards TAPPI 411 ES-68
longitudinal tensile strength (L.T.S.)—Standards TAPPI 494 ES-68
transverse tensile strength (T.T.S.)—Standards TAPPI 494 ES-68
porosity—Standards TAPPI ATICELCA 19-70 absorption of water—by immersion for 30′ in water at 25° C., and expressed as % by weight of water absorbed dimensional stability in hot conditions (*)—by residence of the dried product in a furnace at 60° C. for 30 minutes dimensional stability to water (*)—by residence in water at 25° C. for 30 minutes abrasion resistance—by a "Calderara" abrasion tester evaluating the number of cycles for which a tearing of the specimen under test occurs due to rubbing between two discs of wet cloth, under a load of 2.5 kg. The operative conditions are as follows:

cloth discs of the "Finette" type, having a diameter of 7 cm and a weight of 200 g/m$^2$, and provided with rotary and revolutionary movements, at a speed of 35 cycles/min.

specimen under test, having the following dimensions: 13×14 cm.

soaking of the cloth discs with water every 50 cycles.

(*) Dimensional stability is defined as "very good", "low" or "bad", depending on whether the specimen retains, respectively, unaltered dimensions, or its dimensions undergo a variation of 2–3%, or more than 3%, in respect to the initial dimensions.

EXAMPLE 1

An aqueous suspension at 20% by weight of a fibers mixture was prepared in a hollander, the composition of said mixture being as follows:

45 parts by weight of leather fibers having a length between 2 and 3 mm., prepared by grinding pre-dried leather shavings;

15 parts by weight of cellulose pulp of the "Kraft" type, having a refining degree (°SR)=20;

40 parts by weight of fibrils of polyethylene of melting point 115° C., having a length comprised between 2 and 3 mm., an average (apparent) diameter of about 30 microns, and a surface area of approximately 4 m$^2$/g, and having 30% by weight of powdered kaolin (particle size below 10 microns) incorporated therein.

The homogeneous suspension was additioned with a latex of vinyl chloride/vinylidene chloride copolymer (marketed by Goodrich as "Geon 652") in such amount as to have in the hollander 20 parts by weight of dry copolymer per 100 parts by weight of the fibers mixture.

The final suspension was homogenized and then used to prepare a sheet in a laboratory flat continuous machine. The wet sheet was passed between two rollers, which rendered it of uniform thickness, after which it was dried at a temperature of up to 100° C.

The resulting sheet had an appearance like that of regenerated leather; its characteristics are reported in Table I.

EXAMPLE 2

An aqueous suspension of 20% by weight of a fibers mixture was prepared in a hollander, the mixture having the following composition:

50 parts by weight of leather fibers as in Example 1;

10 parts by weight of birch tree bleached cellulose, having a refining degree (°SR)=25;

40 parts by weight of polyethylene fibrils (melting point=120° C.) containing no fillers, having a length ranging from 2 to 4 mm., an average diameter of about 40 microns, a surface area=4.5 m$^2$/g, prepared according to the process described in Italian Pat. No. 947,919.

The homogeneous suspension obtained was additioned, under stirring, with an aqueous latex made up of equal parts of natural rubber and polyvinyl acetate in such amount as to have in the hollander 20 parts by weight of such mixture in the dry state per 100 parts by weight of fibrous mixture.

Adopting modalities similar to those described in Example 1, the suspension was formed into a sheet that, after drying at 100° C., exhibited the characteristics reported in Table I.

Examples 3, 4 and 5 infra are comparative examples and are given to illustrate the differences in characteristics between the products of the present invention, containing synthetic fibrils of large surface area, and those prepared with conventional fibers or fibrous mixtures, and respectively leather fibers (Example 3), mixtures of leather fibers with cellulose fibers (Example 4), mixtures of leather fibers with cellulose and conventional synthetic fibers (Example 5).

COMPARATIVE EXAMPLE 3

100 parts by weight of leather fibers, prepared from leather shavings as described in Example 1, were mixed with water in a hollander to obtain an aqueous suspension of 20% by weight of fibers.

The suspension was additioned with a mixture, in the form of an aqueous latex consisting, in equal parts, of natural rubber and polyvinyl acetate, in such amount as to have in the hollander 20 parts by weight of such mixture in the dry state per 100 parts by weight of leather fibers. After homogenization, the suspension was used to prepare a uniform fibrous layer according to the modalities described in Example 1. After drying at 100° C., there was obtained a sheet the characteristics of which are reported in Table I.

COMPARATIVE EXAMPLE 4

In this test, an aqueous suspension of 20% by weight of a fibrous mixture was used, the mixture consisting of:

50 parts by weight of Kraft cellulose having a refining degree (°SR)=20;

50 parts by weight of leather fibers prepared as per Example 1, and containing 25 parts by weight of a mixture of natural rubber and polyvinyl acetate that had been added to the fibers suspension in the form of an aqueous latex.

The sheet obtained from said suspension according to the modalities described in Example 1 exhibited, after drying at 100° C., the characteristics reported in Table I.

COMPARATIVE EXAMPLE 5

An aqueous suspension of 20% by weight of a fibrous material was used, the fibrous material being composed of:

10 parts by weight of Kraft cellulose having a refining degree (°SR)=20;

50 parts by weight of leather fibers prepared according to Example 1;

40 parts by weight of polypropylene staple fibers (prestretched 5:1), having a length of about 5 mm and a diameter of 30μ, and containing 38 parts by weight of a mixture consisting, in equal parts, of natural rubber and polyvinyl acetate, added to the suspension in the form of an aqueous latex. Following the modalities described in Example 1, a sheet was prepared which after drying at 100° C., exhibited the characteristics reported in Table I.

TABLE I

| | | Examples | | | | |
|---|---|---|---|---|---|---|
| | | 1 | 2 | 3 | 4 | 5 |
| Weight | $g/m^2$ | 980 | 940 | 1,210 | 1,200 | 1,180 |
| Thickness | mm | 1.5 | 1.5 | 1.5 | 1.5 | 1.5 |
| L.T.S. | $kg/cm^2$ | 32 | 33 | 24.4 | 40 | 54 |
| T.T.S. | $kg/cm^2$ | 26 | 27 | 22 | 32 | 38 |
| Absorption of water | $g/cm^2$ | 150 | 160 | 25 | 20 | 20 |
| Permeability to air | $cm^3/g.h.$ | 400 | 600 | 17 | 100 | 20 |
| Abrasion resistance | cycles | 2,000 | 1,900 | 1,650 | 2,000 | 2,000 |
| Dimensional stability to water | | very good | very good | low | bad | low |
| Dimensional stability at 60° C. | | very good | very good | low | good | low |

What we claim is:

1. Fibrous material useful as a leather substitute and consisting essentially of:

(1) a fibers mixture made up of

30–60% by weight of leather fibers;

35–65% by weight of synthetic polymer fibrils, or fibrides having a surface area exceeding 1 $m^2/g$, the synthetic polymers being polymers of monomers selected from the group consisting of olefins, amides, styrene, acrylonitrile, acrylates, vinyl chloride and oxymethylene, and copolymers of said monomers;

5–15% by weight of cellulose fibers; and (2) a polymeric organic binder for the fibrous material constituting said mixture, in an amount comprised between 3 and 50 parts by weight per 100 parts by weight of the fibers mixture.

2. Fibrous material according to claim 1, in which the synthetic polymer fibrils, or fibrides, are fibrils, or fibrides, of an olefin polymer.

3. Fibrous material according to claim 1, having an apparent density ranging from 0.6 to 1.0 g/cc.

4. Fibrous material according to claim 1, in which the synthetic polymer fibrils, or fibrides, are fibrils, or fibrides, of polyethylene.

5. Fibrous materials according to claim 1, in which the binder for the fibrous material is an aqueous latex made up of equal parts of natural rubber and polyvinyl acetate.

* * * * *